US011524399B1

(12) United States Patent
Fitzgerald

(10) Patent No.: US 11,524,399 B1
(45) Date of Patent: Dec. 13, 2022

(54) SLIDABLE HANDLE GRIP ASSEMBLY AND METHOD

(71) Applicant: James Fitzgerald, Pelican Rapids, MN (US)

(72) Inventor: James Fitzgerald, Pelican Rapids, MN (US)

( * ) Notice: Subject to any disclaimer, the term of this patent is extended or adjusted under 35 U.S.C. 154(b) by 0 days.

(21) Appl. No.: 17/361,587

(22) Filed: Jun. 29, 2021

(51) Int. Cl.
*B25G 1/06* (2006.01)

(52) U.S. Cl.
CPC ..... *B25G 1/06* (2013.01)

(58) Field of Classification Search
CPC ..... B25G 1/06
See application file for complete search history.

(56) References Cited

U.S. PATENT DOCUMENTS 3,981,043 A * 9/1976 Curry ..... B25G 1/06 16/430
5,348,360 A * 9/1994 Mencarelli ..... B25G 1/10 74/551.9
5,390,746 A * 2/1995 Page ..... B25G 1/06 81/489
5,581,839 A * 12/1996 Ferrell, Jr. ..... A47L 13/42 15/229.6
5,823,077 A * 10/1998 Macor ..... B25B 13/08 81/177.1
5,974,775 A * 11/1999 Niehuss ..... A01D 7/00 294/58
6,092,442 A * 7/2000 Macor ..... B25G 1/063 81/177.1
7,694,392 B2 * 4/2010 Touchette ..... B25G 1/06 16/430
8,616,597 B2 * 12/2013 Guerra ..... B25G 1/00 294/58
9,003,592 B2 * 4/2015 Smith ..... A46B 17/08 16/110.1
9,987,739 B2 * 6/2018 Frascello ..... B25G 3/10
10,569,149 B2 * 2/2020 Clarke ..... A63B 60/20
2010/0263493 A1 * 10/2010 Savalla ..... B25D 1/00 81/20

* cited by examiner

*Primary Examiner* — Jeffrey O'Brien

(57) ABSTRACT

A slidable handle grip assembly includes a tubular member that has a first end, a second end, and a perimeter wall extending between the first and second ends. The first and second ends are open. The tubular member is positioned on an elongated shaft of a tool such that the tubular member can slidably move from a grip end to a head end of the tool. An outer surface of the perimeter wall defines a supplemental handhold for the shaft.

16 Claims, 8 Drawing Sheets

SLIDABLE HANDLE GRIP ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sliding handle devices and more particularly pertains to a new sliding handle device to facilitate movement of a person's hand in a more frictionless manner along a shaft of a broom, rake, or shovel to more easily move the heads of those tools back and forth. Moreover, the sliding handle device encourages more ergonomic benefits such as, in particular, the ability of a user of the device to maintain a more vertical posture to prevent injuries to the user's back and the requirement of less muscle movement and exertion.

(2) Description of Related Art Including Information Disclosed Under 37 CFR 1.97 and 1.98

The prior art relates to sliding handle devices that are used with tools to allow for more efficient manipulation of the tools. However, these devices were not easily retrofittable to existing tools and were typically created for specific tasks.

BRIEF SUMMARY OF THE INVENTION

An embodiment of the disclosure meets the needs presented above by generally comprising a tubular member that has a first end, a second end, and a perimeter wall extending between the first and second ends. The first and second ends are open. The tubular member is configured to be positioned on an elongated shaft of a tool such that the tubular member can slidably move from a grip end to a head end of the tool. An outer surface of the perimeter wall defines a supplemental handhold for the shaft.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
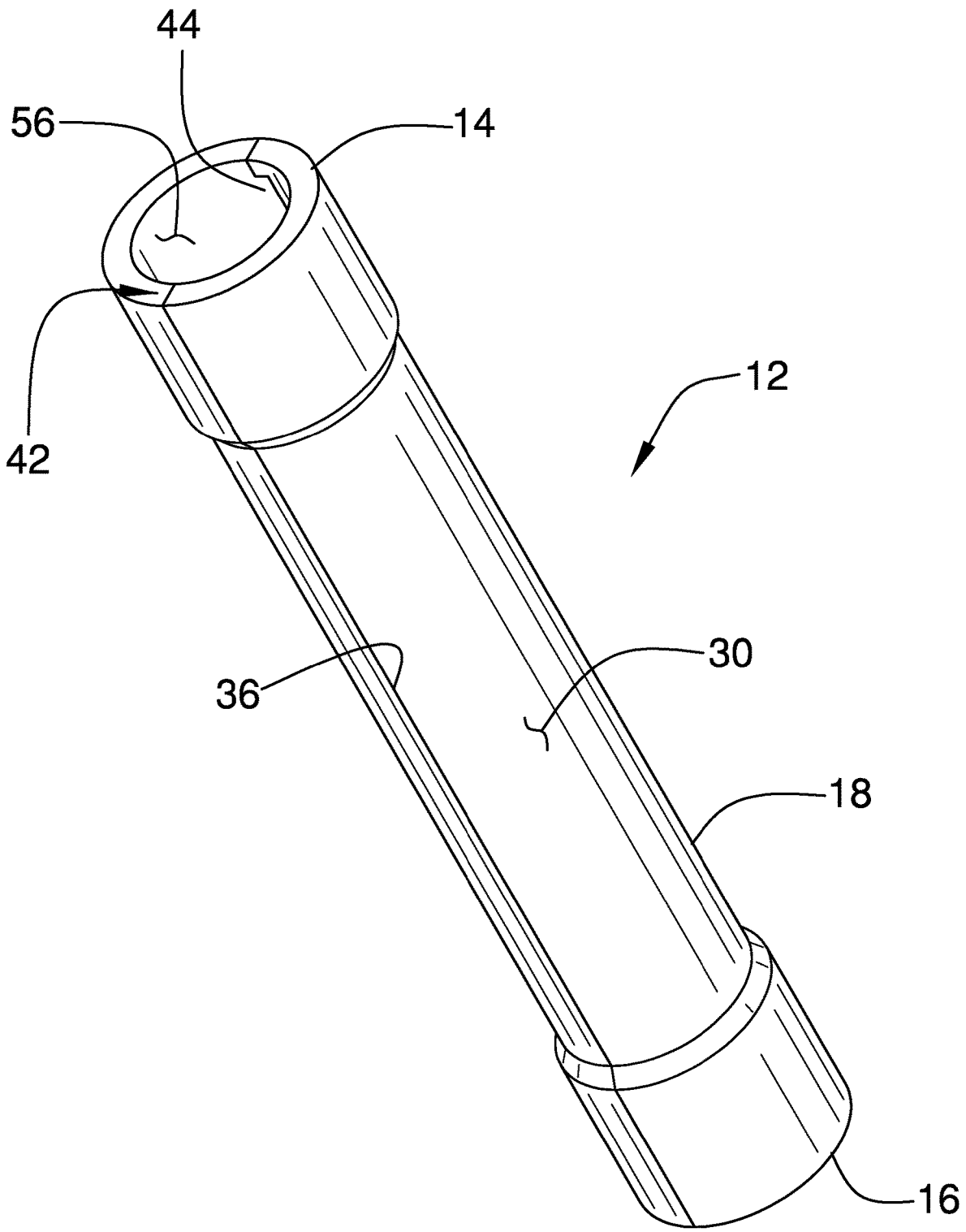
FIG. 1 is a top isometric view of a slidable handle grip assembly and method according to an embodiment of the disclosure.
Figure 2:
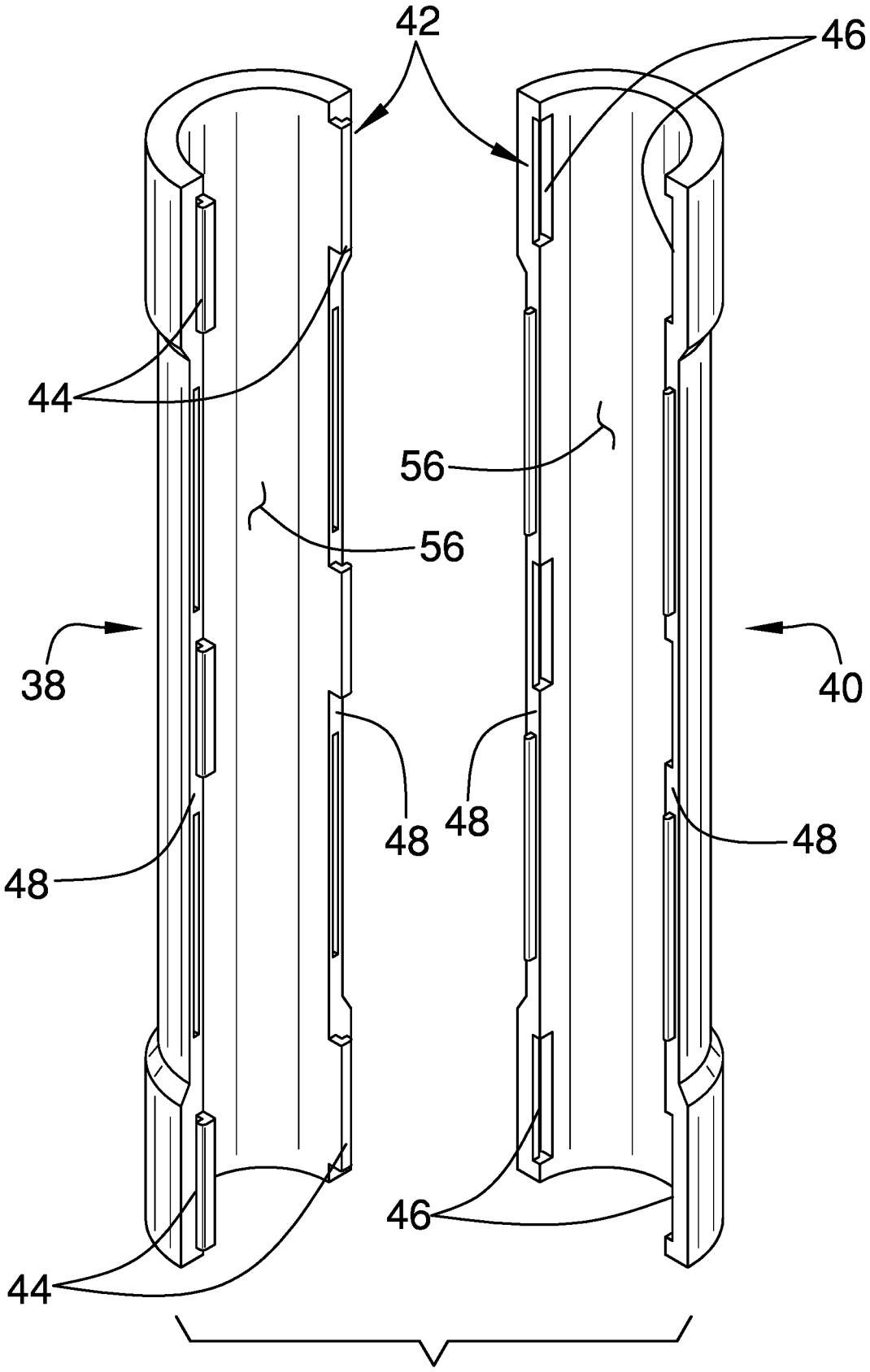
FIG. 2 is a front isometric view of an embodiment of the disclosure.
Figure 3:
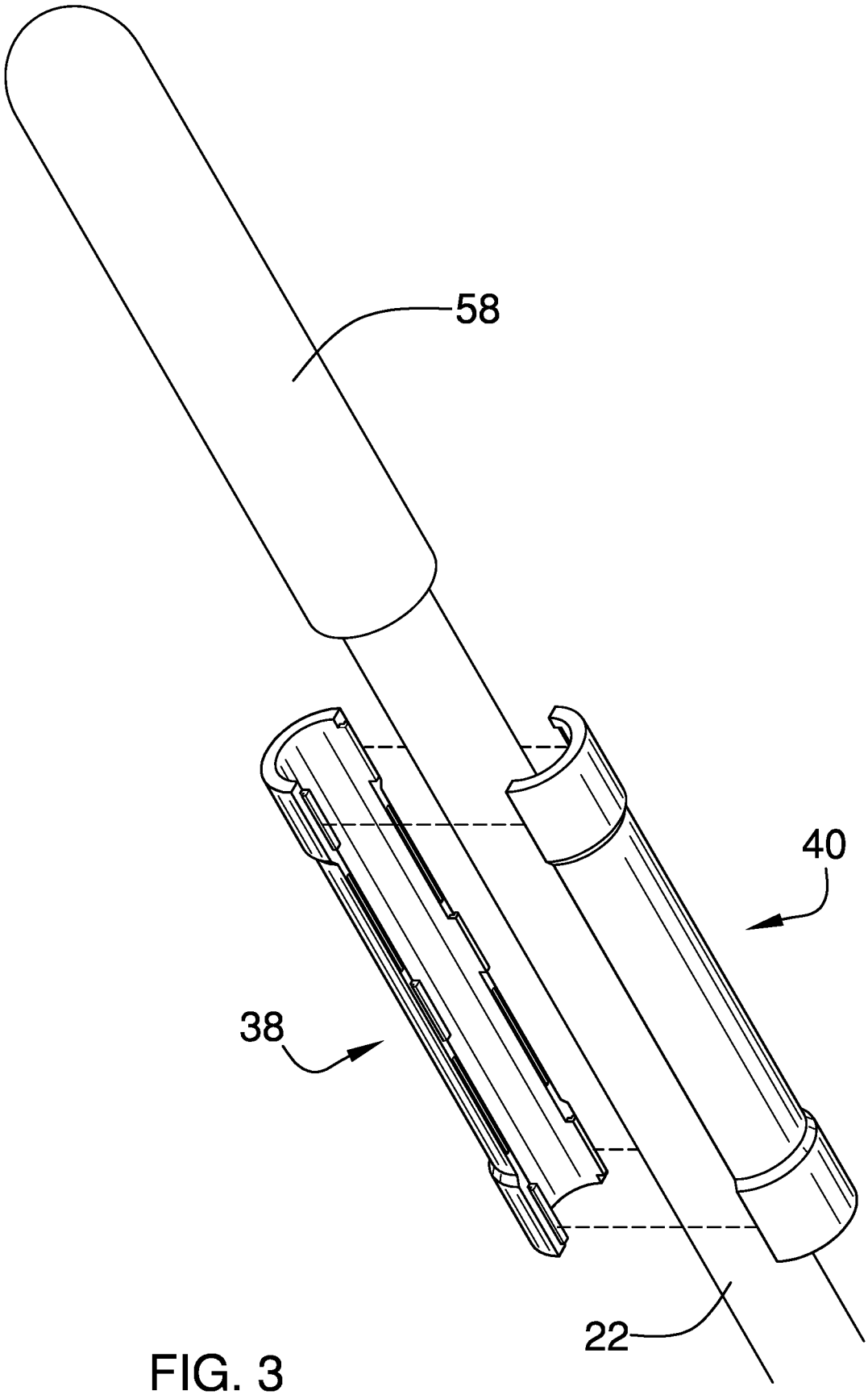
FIG. 3 is a front isometric view of an embodiment of the disclosure.
Figure 4:
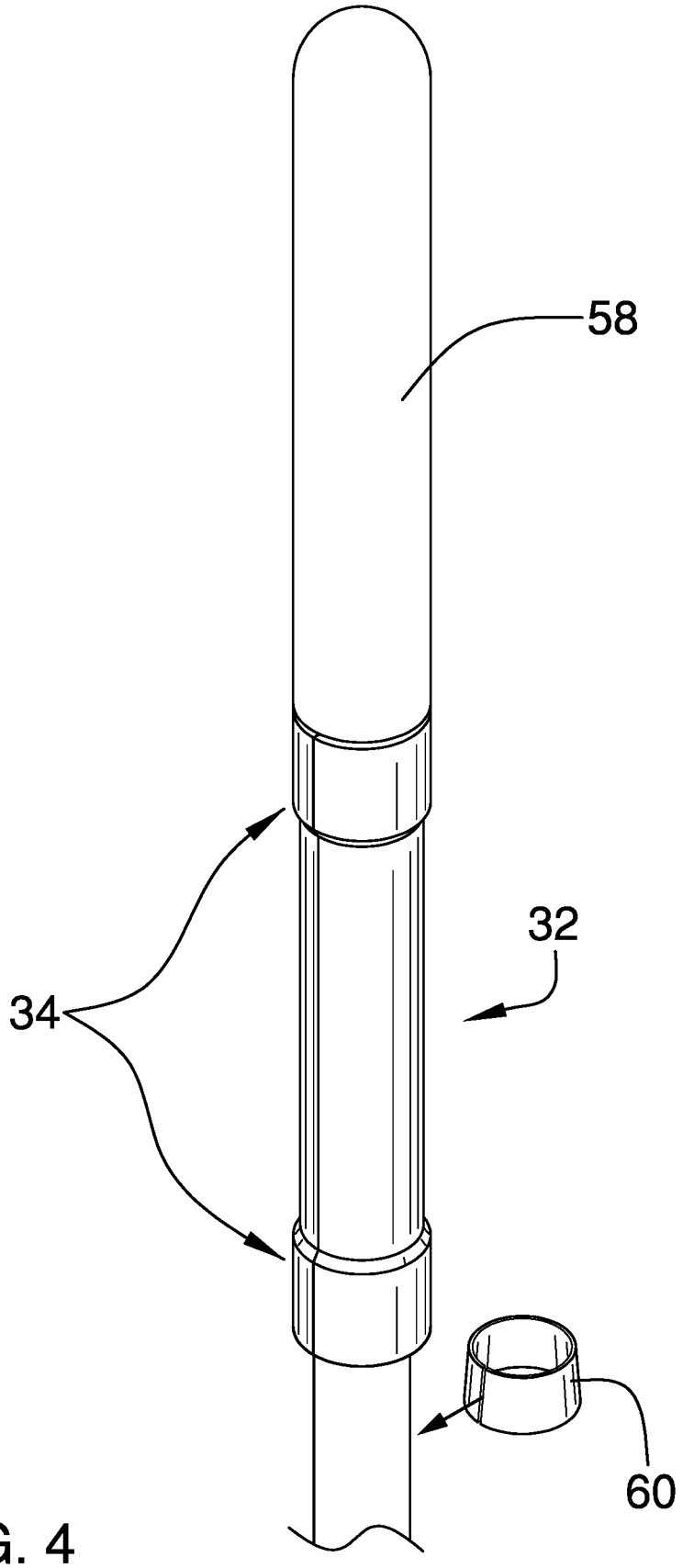
FIG. 4 is a rear isometric view of an embodiment of the disclosure.
Figure 5:
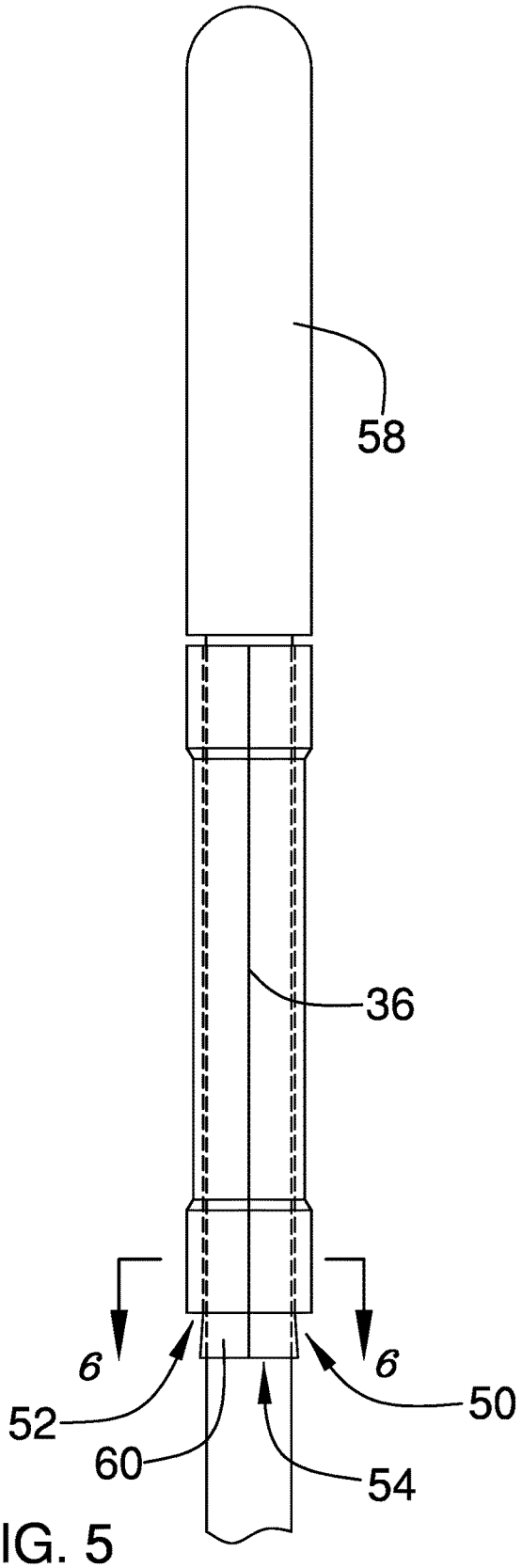
FIG. 5 is a front view of an embodiment of the disclosure.

With reference now to the drawings, and in particular to FIGS. 1 through 9 thereof, a new sliding handle device embodying the principles and concepts of an embodiment of the disclosure and generally designated by the reference numeral 10 will be described.

Figure 6:
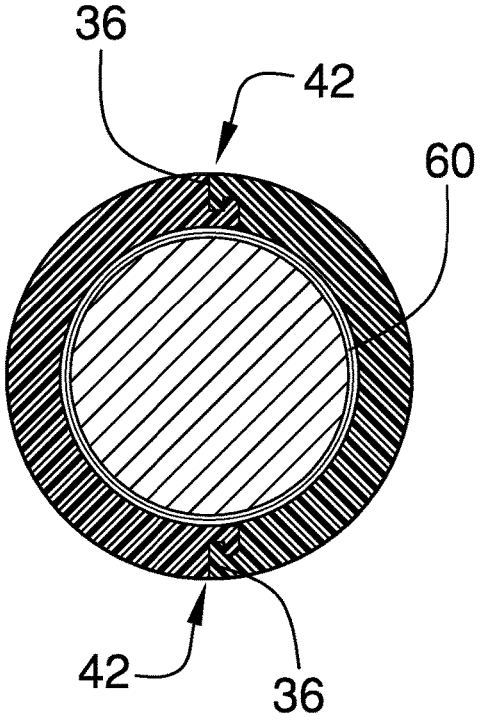
FIG. 6 is a cross-sectional view of an embodiment of the disclosure taken along line 6-6 of FIG. 5.
Figure 7:
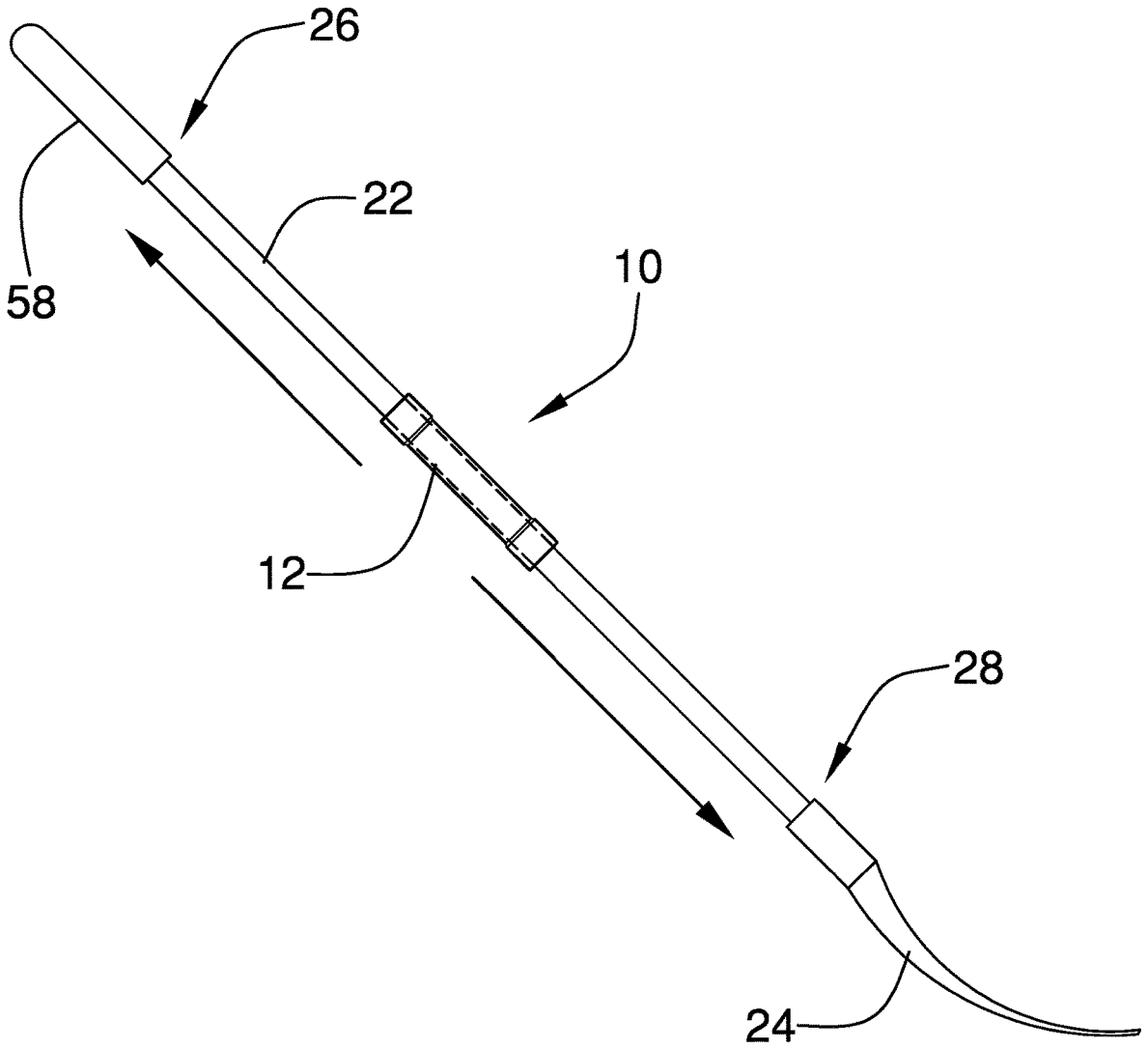
FIG. 7 is a side view of an embodiment of the disclosure.
Figure 8:
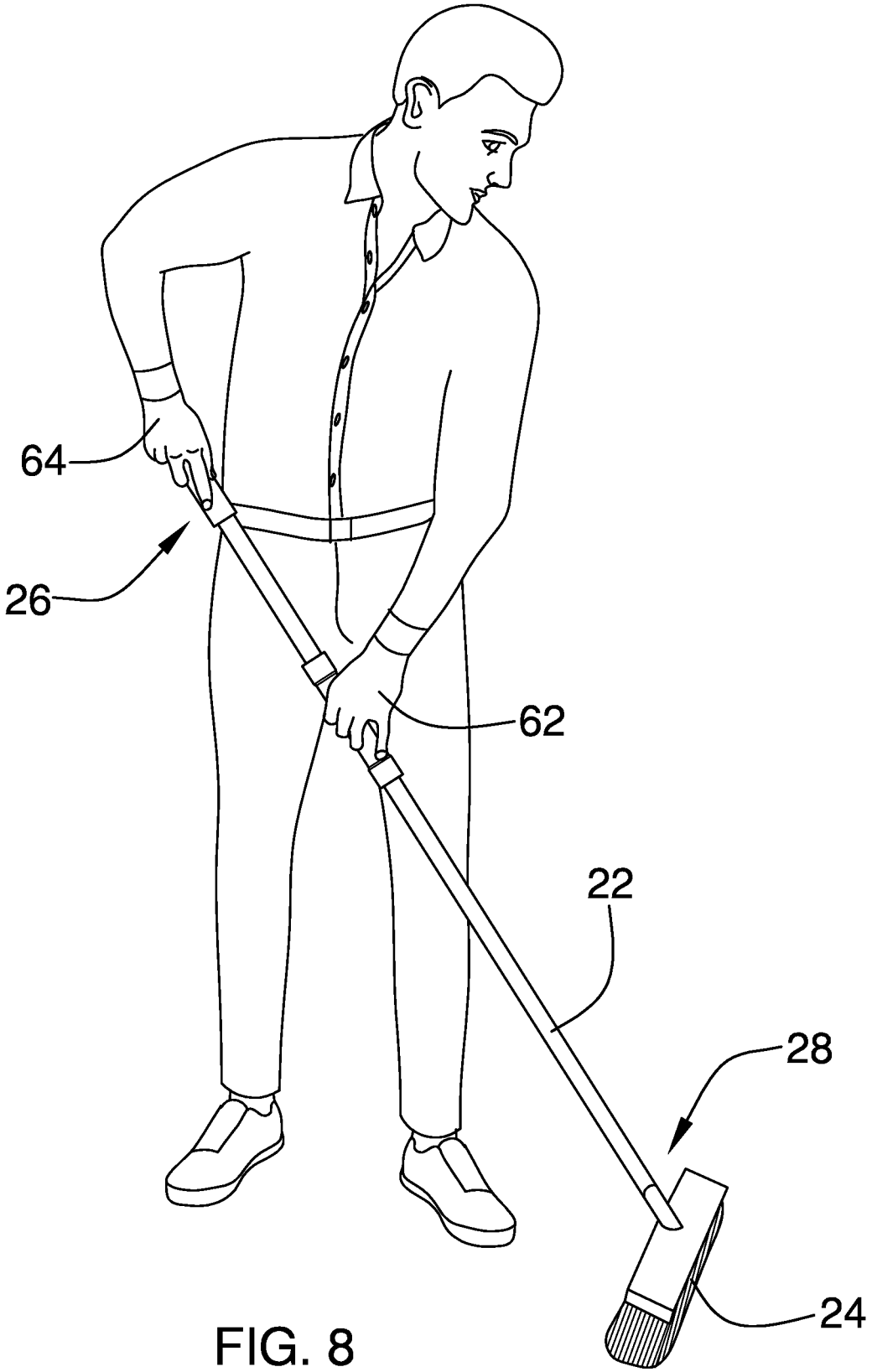
FIG. 8 is a side view of an embodiment of the disclosure.
Figure 9:
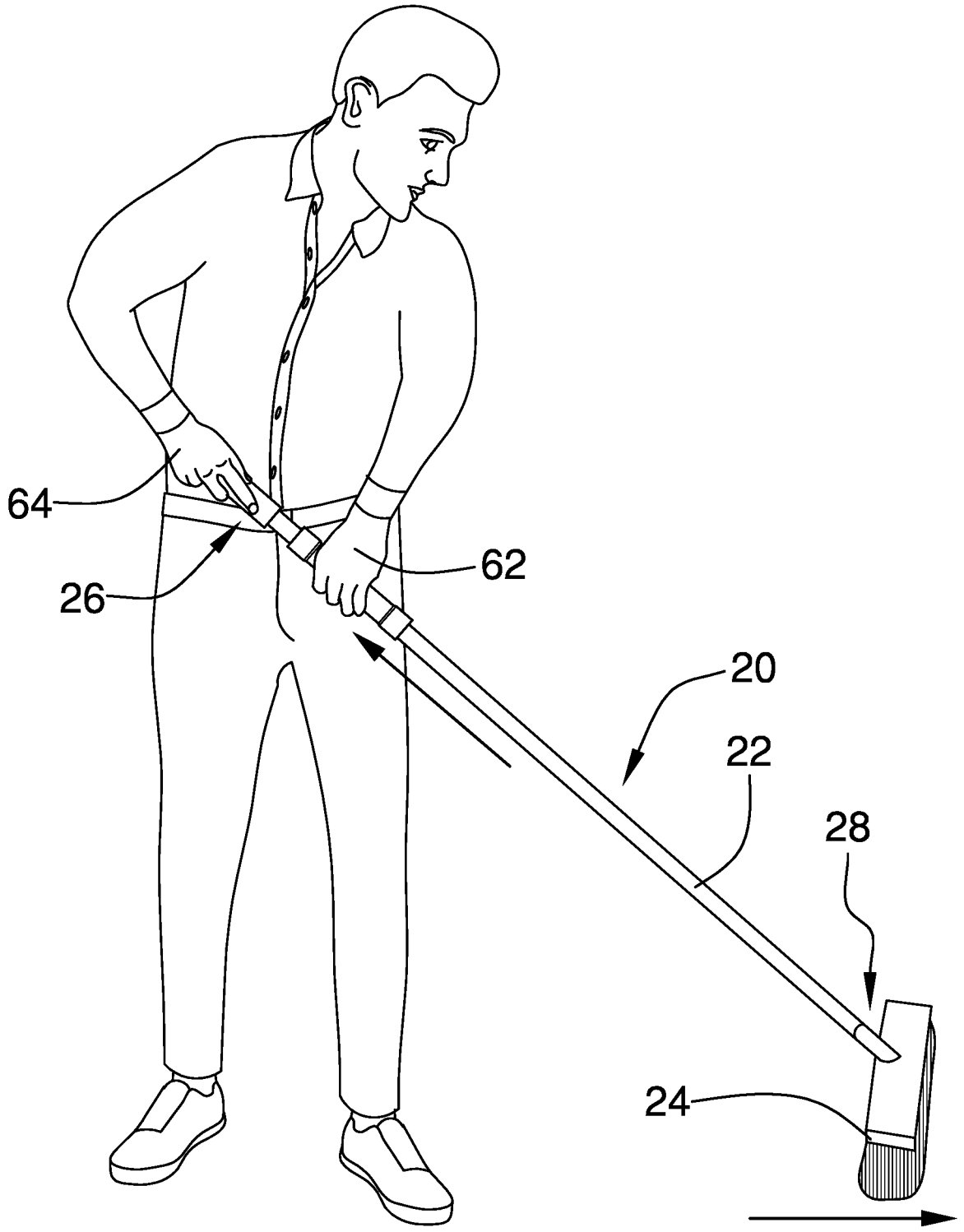
FIG. 9 is a side view of an embodiment of the disclosure.

As best illustrated in FIGS. 1 through 9, the slidable handle grip assembly 10 and method generally comprises a tubular member 12 having a first end 14, a second end 16, and a perimeter wall 18 extending between the first 14 and second 16 ends. The first 14 and second ends 16 are both open. The tubular member 12 is configured to be positioned on an elongated shaft 22 of a tool 20, such as, but not limited to, push brooms, snow shovels, rakes, and the like. Generally, any tool which requires its head 24 to be moved in a back and forth motion, is gripped with both hands, and has a length typically greater than 4.0 feet. The head 24 will most typically comprise a broom head or a shovel blade. The type of broom head or shovel blade utilized will depend on the type of task undertaken and therefore a shovel blade for pushing snow will be different than a shovel blade for lifting and digging into soil. The tubular member 12 is slidably moved from a grip end 26 to a head end 28 of the tool 20. An outer surface 30 of the perimeter wall 18 defines a supplemental handhold for the shaft 22 which is gripped by a user's lower hand, relative to the head 24, as shown in FIG. 8. While other shapes are possible, the perimeter wall 16 may have a cylindrical shape such that a cross-section of the tubular member 12 taken perpendicular to a line extending though the first 14 and second 16 ends is circular as shown in FIG. 6. The cross-section may include other arcuate shapes such as oval or an oblong oval and therefore may be configured to better conform to a person's hand.

In some embodiments, the outer surface 30 of the tubular member 12 includes a central area 32, and a pair of outer areas 34. The first 14 and second 16 ends each includes one of the outer areas 34. At least one, or both, of the outer areas 34 has a greater circumference than the central area 32. The outer areas 34, by having a larger circumference, provide raised areas for abutment against a person's hand to help retain the user's hand on the tubular member 12.

The perimeter wall 18 has pair of breaks 36 therein. Each of the breaks 36 extends through the first 14 and second 16 ends such that a first section 38 and a second section 40 of the tubular member 12 are defined. The breaks 36 will typically be positioned opposite of each other. The first 38 and second 40 sections may be hingedly coupled together or may be releasably attached to each other. A coupler 42 releasably secures the first 38 and second 40 sections together. The coupler 42 may include a first mating member 44 positioned on the first section 38 and a second mating member 46 positioned on the second section 40. As can be seen in the Figures, in one embodiment the first section 38 may include a plurality of first mating members 44 and the second section 40 a plurality of second mating members 46. In other embodiments, the first 38 and second 40 sections may each include first 44 and second 46 mating members. The first 44 and second 46 mating members may include male and female couplers that are snapped together. Alternate couplers may be utilized, though first 44 and second 46 mating members positioned in edges 48 of the perimeter wall 18 formed by the breaks 36 will allow for the outer surface 30 to remain substantially smooth.

A stop 50 is configured to releasably lock the tubular member 12 in a static position relative to the shaft 22. The stop 50 includes a first connector 52 and a second connector 54 matingly couplable together either mechanically or frictionally. Typically, the tubular member 12 includes the first connector 52 and the second connector 54 is positioned on the shaft 22. In one embodiment, the first connector 52 is formed by an interior surface 56 of the tubular member 12 having a width to receive the second connector 54. The second connector 54 may comprise the end of a grip 58 positioned on the shaft 22 wherein the tubular member 12 receives a portion of and frictionally engages the grip 58 and is thereby retained in place. In another embodiment, the second connector 54 may comprise a loop 60 extended around the shaft 22. The loop 60 may be shaped to be received by the tubular member 12 and thereafter flares outwardly to increase friction as the loop 60 is brought into the tubular member 12. However, this ability of the loop 60 to be received by the tubular member 12 can also be achieved with a uniform cylindrical structure that is resiliently compressible. The usage of a loop 60 includes the benefit of allowing selectively locking of the tubular member 12 anywhere along the shaft 22. The loop 60 may be comprised of a resiliently stretchable material allowing it to accommodate shafts 22 of differing sizes. In yet another embodiment, the first 52 and second 54 connectors may include a ridge and trough combination wherein the tubular member includes one of the ridge or the trough while the other of the ridge or trough is positioned on the shaft 22, grip 58 or a connector for the head 24.

The tubular member 12 has a length from the first end 14 to the second end 16 that is between 5.0 inches and 9.0 inches. The tubular member 12 preferably has an outer diameter between 0.75 inches and 3.0 inches and more preferably has an outer diameter that less than 2.0 inches. Generally, the tubular member will be free of any large protuberances or handles such that the assembly 10 does not have a measurement, in any direction orientated perpendicular to a longitudinal axis extending through the first and second ends, which exceeds 3.0 inches.

In use, the method of using the assembly 10 includes the positioning of the first 38 and second 40 sections around the shaft 22 and securing the first 38 and second 40 sections together such that the tubular member 12 is slidably movable along the shaft 22. The tubular member 12 is gripped by the user's first hand 62 such that the fingers of the first hand 62 extend around the shaft 22 as well. The user's second hand 64 holds onto the grip 58. The grip 58 is pushed forward toward the tubular member 12 causing the head 24 of the tool 20 to slide forward across the ground surface. The reverse action is completed to move the head 24 back toward the user. The tubular member 12 reduces friction between the shaft 22 and the first hand 62. The assembly 12 therefore allows, for example, easier pushing of snow or debris away from the user, or pulling leaves toward the user wherein the user is able to maintain a more upright, vertical posture through the movement of the head 24. Thus, the lifting and throwing of dirt or other materials may also be made easier with the tubular member 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sliding handle assembly for a tool with an elongated shaft, said assembly comprising:

a tubular member having a first end, a second end, and a perimeter wall extending between said first and second ends, said first and second ends being open, said tubular member being configured to be positioned on the elongated shaft such that the tubular member can slidably move from a grip end to a head end of the tool, an outer surface of the perimeter wall defining a supplemental handhold for the shaft;

said perimeter wall having pair of breaks therein, each of said breaks extending through said first and second ends such that a first section and a second section of said tubular member are defined; and a coupler securing said first and second sections together, said coupler being releasable wherein said coupler is configured for being from the shaft, said coupler including a first mating member being L-shaped positioned on said first section and a second mating member being complementary in shape to said first mating member, said second mating member being positioned extending into said second section, said first section being in abutment with said second section when said first mating member is engaged to said second mating member such that an outside surface of said first section is flush with an outside surface of said second section.

2. The sliding handle assembly according to claim 1, wherein said outer surface includes a central area, and a pair of outer areas, wherein each of said first and second ends includes one of said outer areas, said outer areas having a greater circumference than said central area.

3. The sliding handle assembly according to claim 2, wherein said perimeter wall has a cylindrical shape.

4. The sliding handle assembly according to claim 1, wherein said breaks are positioned opposite of each other.

5. The sliding handle assembly according to claim 1, further including a stop being configured to releasably lock said tubular member in a static position relative to the shaft.

6. The sliding handle assembly according to claim 5, wherein said stop includes a first connector and a second connector matingly couplable together, said tubular member including said first connector, the second connector being positionable on the shaft.

7. The sliding handle assembly according to claim 1, wherein said tubular member has a length from said first end to said second end being between 5.0 inches and 9.0 inches, the tubular member having an outer diameter between 0.75 inches and 3.0 inches.

8. The sliding handle assembly according to claim 2, wherein said tubular member has a length from said first end to said second end being between 5.0 inches and 9.0 inches, the tubular member having an outer diameter between 0.75 inches and 3.0 inches.

9. A sliding handle and tool combination system comprising:

a tool having shaft being elongated, a head being attached to one end of the shaft and a grip being attached to another end of the shaft;

a tubular member having a first end, a second end, and a perimeter wall extending between said first and second ends, said first and second ends being open, said tubular member being positioned on the shaft such that the tubular member can slidably move from the grip to the head, an outer surface of the perimeter wall defining a supplemental handhold for the shaft;

said perimeter wall having pair of breaks therein, each of said breaks extending through said first and second ends such that a first section and a second section of said tubular member are defined; and a coupler securing said first and second sections together, said coupler being releasable wherein said coupler is configured for being removed from the shaft said coupler including a first mating member being L-shaped positioned on said first section and a second mating member being complementary in shape to said first mating member, said second mating member being positioned extending into said second section, said first section being in abutment with said second section when said first mating member is engage to said second mating member such that an outside surface of said first section is flush with an outside surface of said second section.

10. The sliding handle and tool combination system according to claim 9, wherein said outer surface includes a central area, and a pair of outer areas, wherein each of said first and second ends includes one of said outer areas, said outer areas having a greater circumference than said central area.

11. The sliding handle and tool combination system according to claim 10, wherein said perimeter wall has a cylindrical shape.

12. The sliding handle and tool combination system according to claim 9, wherein said breaks are positioned opposite of each other.

13. The sliding handle and tool combination system according to claim 12, further including a stop being configured to releasably lock said tubular member in a static position relative to the shaft.

14. The sliding handle and tool combination system according to claim 13, wherein said stop includes a first connector and a second connector matingly couplable together, said tubular member including said first connector, the second connector being positioned on the shaft.

15. The sliding handle and tool combination system according to claim 9, wherein said tubular member has a length from said first end to said second end being between 5.0 inches and 9.0 inches, the tubular member having an outer diameter between 0.75 inches and 2.0 inches.

16. The sliding handle and tool combination system according to claim 9, wherein said tubular member has a length from said first end to said second end being between 5.0 inches and 9.0 inches, the tubular member having an outer diameter between 0.75 inches and 3.0 inches.

* * * * *